US012379149B2

(12) United States Patent
Shirata et al.

(10) Patent No.: US 12,379,149 B2
(45) Date of Patent: Aug. 5, 2025

(54) COLD STORAGE

(71) Applicant: PHC Holdings Corporation, Tokyo (JP)

(72) Inventors: Mitsuyuki Shirata, Ehime (JP); Naoki Yanagihara, Gunma (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 101 days.

(21) Appl. No.: 18/365,752

(22) Filed: Aug. 4, 2023

(65) Prior Publication Data

US 2023/0384018 A1 Nov. 30, 2023

Related U.S. Application Data

(63) Continuation of application No. PCT/JP2022/004488, filed on Feb. 4, 2022.

(30) Foreign Application Priority Data

Mar. 18, 2021 (JP) ..... 2021-044986

(51) Int. Cl.
*F25D 29/00* (2006.01)
*F25B 49/02* (2006.01)
*F25D 21/00* (2006.01)

(52) U.S. Cl.
CPC ..... *F25D 21/006* (2013.01); *F25B 49/022* (2013.01); *F25D 29/00* (2013.01); (Continued)

(58) Field of Classification Search
CPC .. F25B 49/022; F25B 2600/12; F25D 21/006; F25D 29/00; F25D 2600/04; F25D 2700/12; F25D 2700/14
See application file for complete search history.

(56) References Cited

U.S. PATENT DOCUMENTS

2005/0235669 A1* 10/2005 Cho ..... F25D 29/00 62/158

FOREIGN PATENT DOCUMENTS

JP 2014-035146 A 2/2014
KR 2005-0049237 A 5/2005

OTHER PUBLICATIONS

Extended European Search Report dated Apr. 30, 2024 from corresponding EP Application No. 22770931.8, 7 pages.

(Continued)

*Primary Examiner* — Jonathan Bradford
(74) *Attorney, Agent, or Firm* — Rimon P.C.

(57) ABSTRACT

A cold storage includes a box with a cold storage chamber, a compressor constituting a refrigeration circuit that cools the inside of the cold storage chamber, a defrost heater that heats an evaporator constituting the refrigeration circuit, and a control apparatus that controls the compressor and the defrost heater. The control apparatus operates the defrost heater when the compressor is not operated. When an outside air temperature is equal to or higher than a chamber temperature in the cold storage chamber, the control apparatus operates the compressor upon the chamber temperature rising up to a first threshold and stops the compressor upon the chamber temperature dropping down to a second threshold lower than the first threshold. When the outside air temperature is lower than the chamber temperature, the control apparatus does not operate the compressor even when the chamber temperature rises up to the first threshold.

4 Claims, 6 Drawing Sheets

(52) U.S. Cl.
CPC ..... *F25B 2600/02* (2013.01); *F25D 2600/04* (2013.01); *F25D 2700/12* (2013.01); *F25D 2700/14* (2013.01)

(56) References Cited

OTHER PUBLICATIONS

International Search Report dated Mar. 8, 2022 issued in International Patent Application No. PCT/JP2022/004488, with English translation.

* cited by examiner

COLD STORAGE

CROSS-REFERENCE OF RELATED APPLICATIONS

This application is a Continuation of International Patent Application No. PCT/JP2022/004488, filed on Feb. 4, 2022, which in turn claims the benefit of Japanese Patent Application No. 2021-044986, filed on Mar. 18, 2021, the entire disclosures of which Applications are incorporated by reference herein.

TECHNICAL FIELD

The present disclosure relates to a cold storage.

BACKGROUND ART

A cold storage disclosed in Patent Literature (PTL) 1 includes a cold storage chamber, an outer wall surrounding the cold storage chamber, a heat generator disposed outside the cold storage chamber, and a heat dissipator causing air heated by heat generated from the heat generator to rise along the outer wall. Such a configuration can prevent dew condensation from generating on the outer wall and can improve energy efficiency of the cold storage.

CITATION LIST

Patent Literature

PTL 1

Japanese Patent Application Laid-Open No. 2014-35146

SUMMARY OF INVENTION

Technical Problem

In recent years, a cold storage has been used in a wider range of applications, and target substances, such as pharmaceuticals, have been demanded to be kept at a lower temperature. As the temperature in the cold storage is set to a lower level, the power consumption of a refrigeration circuit increases. On the other hand, there is a demand for saving energy in the cold storage.

An object of the present disclosure is to achieve energy saving in the cold storage.

Solution to Problem

In order to achieve the abovementioned object, a cold storage according to the present disclosure includes: a box having a cold storage chamber; a compressor constituting a refrigeration circuit that cools an inside of the cold storage chamber; a defrost heater that heats an evaporator constituting the refrigeration circuit; and a control apparatus that controls the compressor and the defrost heater, in which the control apparatus operates the defrost heater when the compressor is not operated, when an outside air temperature is equal to or higher than a chamber temperature in the cold storage chamber, the control apparatus operates the compressor upon the chamber temperature rising up to a first threshold and stops the compressor upon the chamber temperature dropping down to a second threshold lower than the first threshold, and when the outside air temperature is lower than the chamber temperature, the control apparatus does not operate the compressor even when the chamber temperature rises up to the first threshold.

Advantageous Effects of Invention

With the cold storage according to the present disclosure, energy saving can be realized.

DESCRIPTION OF EMBODIMENTS

An embodiment of a cold storage according to the present disclosure will be described below with reference to the drawings. In the following description, it is assumed that, as denoted by arrows in FIG. 1, a side where sliding door 30 is disposed is a front side with respect to cold storage 1, and a side opposite to the above side is a rear side with respect to cold storage 1. Left and right sides when cold storage 1 is viewed from the front are respectively left and right sides with respect to cold storage 1. A side away from a plane on which cold storage 1 is installed is an upper side with respect to cold storage 1, and a side opposite to the above side is a lower side with respect to cold storage 1.

Figure 1:
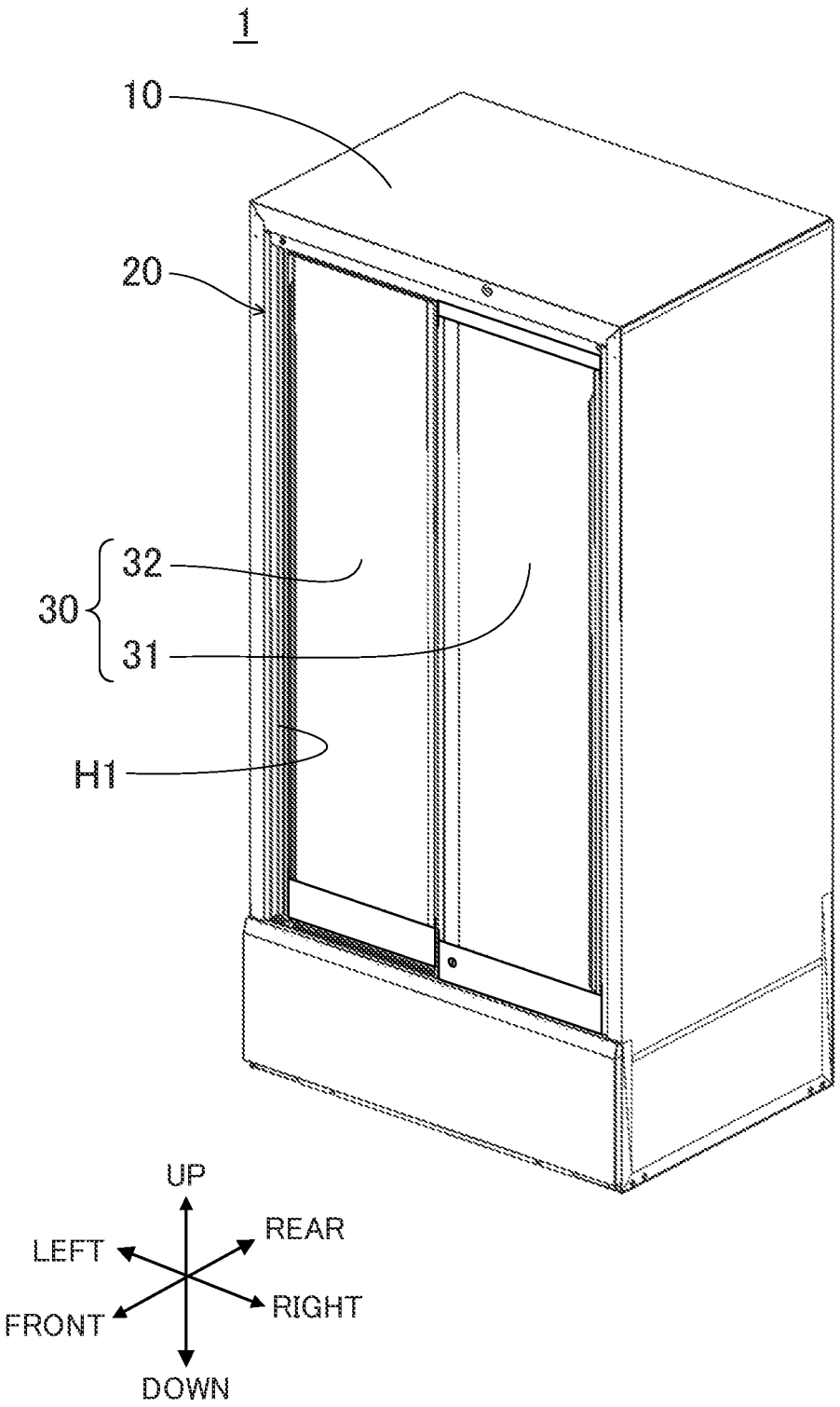
FIG. 1 is a perspective view of a cold storage according to an embodiment of the present disclosure.
Figure 2:
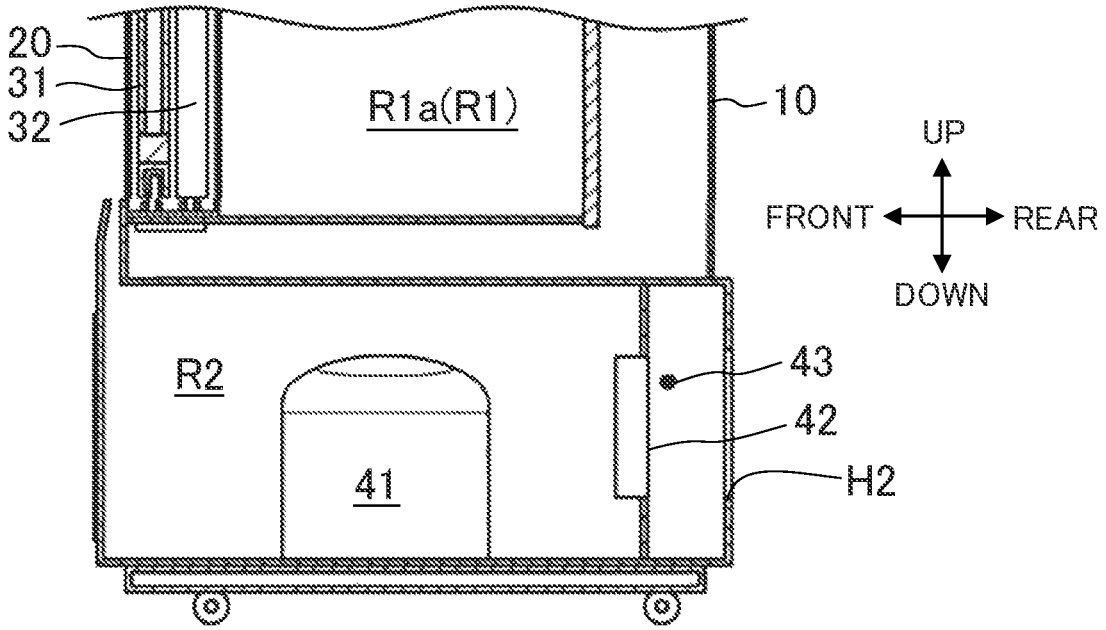
FIG. 2 is a partial vertical sectional view illustrating a configuration inside a machine chamber.

Cold storage 1 is a pharmaceutical cold storage for storing pharmaceuticals at a low temperature. Cold storage 1 may be a cold storage for blood or a constant temperature container. As illustrated in FIGS. 1 and 2, cold storage 1 includes box 10, frame 20, and sliding door 30.

Figure 3:
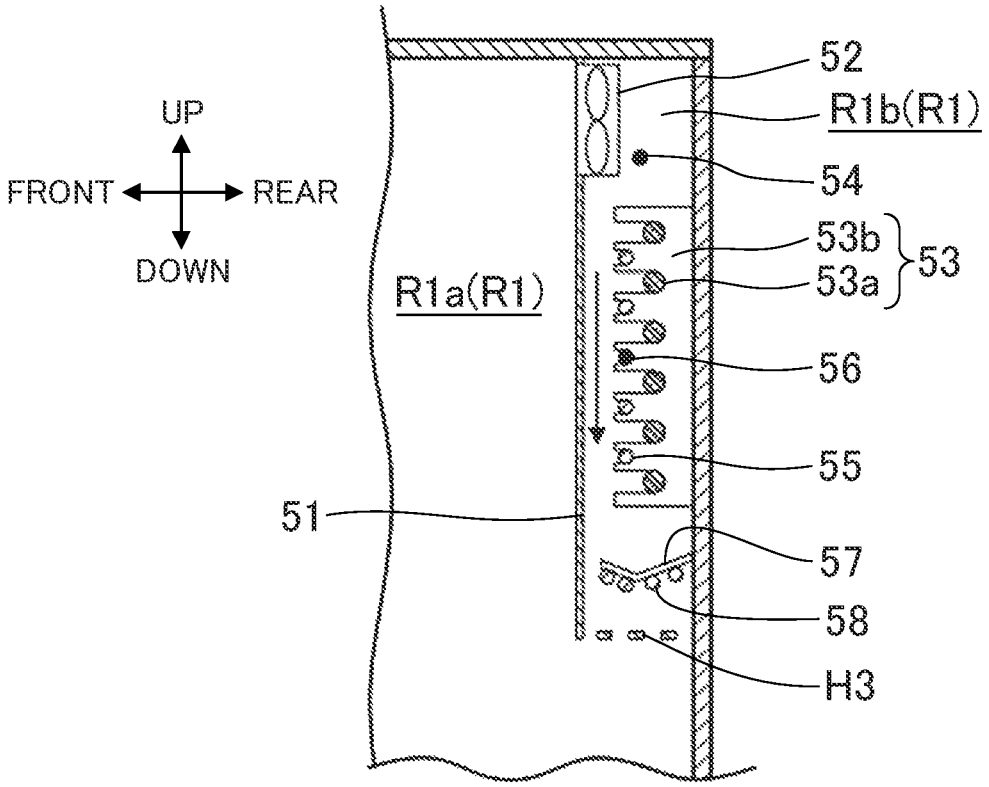
FIG. 3 is a partial vertical sectional view illustrating a configuration inside a cold storage chamber.

Box 10 has, in its front surface, opening H1 that provides an entrance opened and closed with movement of sliding door 30. A heat insulating material is filled between an outer surface and an inner surface of box 10. A space surrounded by the inner surface of box 10 serves as cold storage chamber R1, namely a space in which pharmaceuticals are stored (FIGS. 2 and 3).

Frame 20 is attached to box 10 in such a way of bordering opening H1. Sliding door 30 is attached to frame 20. Sliding door 30 includes first sliding door 31 and second sliding door 32.

First sliding door 31 is attached to be movable in a left-right direction. First sliding door 31 is positioned in a right-side region within frame 20 in a closed state. Second sliding door 32 is attached to be movable in the left-right direction. Second sliding door 32 is positioned in a left-side region within frame 20 in a closed state. Opening H1 and hence cold storage chamber R1 are opened and closed with movements of first sliding door 31 and second sliding door 32.

Box 10 further includes machine chamber R2 under cold storage chamber R1 (FIG. 2).

Compressor 41, a condenser (not illustrated), ventilation fan 42, and an outside air temperature sensor 43 are disposed in machine chamber R2. Compressor 41 constitutes a refrigeration circuit for cooling the inside of cold storage chamber R1.

Ventilation fan 42 ventilates machine chamber R2. With rotation of ventilation fan 42, air outside cold storage 1 flows into machine chamber R2 through opening H2 that is formed in a rear wall of machine chamber R2 of cold storage 1.

Outside air temperature sensor 43 detects a temperature of the air outside cold storage 1 (hereinafter also referred to as an "outside air temperature"). Outside air temperature sensor 43 is disposed between ventilation fan 42 and opening H2. Because any heat source is not present between ventilation fan 42 and opening H2, a temperature detected by outside air temperature sensor 43 is equal to the temperature of the air outside cold storage 1 (more specifically, the temperature of the air around opening H2 on the rear side thereof). Outside air temperature sensor 43 may be disposed at a position other than between ventilation fan 42 and opening H2.

As illustrated in FIG. 3, cold storage chamber R1 is partitioned by sidewall 51 into storage region R1*a* and cooling region R1*b*. Storage region R1*a* is a region where the pharmaceuticals and so on are stored. Cooling region R1*b* is a region where air inside cold storage chamber R1 is cooled.

Fan 52 for the cold storage chamber, evaporator 53 constituting the refrigeration circuit, chamber temperature sensor 54, defrost heater 55, defrost sensor 56, drain pan 57, and drain pan heater 58 are disposed in an upper end portion of cold storage chamber R1 on the rear side. The surrounding of evaporator 53 serves as cooling region R1*b*. Stated another way, fan 52 for the cold storage chamber, evaporator 53, chamber temperature sensor 54, defrost heater 55, defrost sensor 56, drain pan 57, and drain pan heater 58 are disposed in cooling region R1*b*.

Fan 52 for the cold storage chamber is rotated and takes air in storage region R1*a* into cooling region R1*b*. Fan 52 for the cold storage chamber is disposed in an upper end zone of cooling region R1*b*. Accordingly, fan 52 for the cold storage chamber takes in the air present in an upper zone of storage region R1*a*. The air having been taken into cooling region R1*b* is blown into storage region R1*a* through an opening H3 that is formed at the bottom of cooling region R1*b*. Thus, as indicated by an arrow in FIG. 3, the air having been taken into cooling region R1*b* flows downward from the upper end zone of cooling region R1*b*.

Evaporator 53 constitutes the refrigeration circuit. Evaporator 53 cools the air having been taken into cooling region R1*b*. Evaporator 53 is disposed on a lower side than fan 52 for the cold storage chamber. Evaporator 53 includes pipe 53*a* through which a coolant circulating in the refrigeration circuit flows, and fin 53*b* attached to be held in contact with pipe 53*a*.

Chamber temperature sensor 54 detects a temperature in cold storage chamber R1 (hereinafter also simply referred to as a "chamber temperature"). Chamber temperature sensor 54 is disposed in cooling region R1*b* on an upper side than evaporator 53. In other words, chamber temperature sensor 54 detects the temperature of the air having been taken into cooling region R1*b* before the taken-in air is cooled by evaporator 53. Thus, the temperature detected by chamber temperature sensor 54 is equal to the temperature of the air in storage region R1*a*.

Defrost heater 55 heats evaporator 53. When operated, defrost heater 55 melts frost adhering to pipe 53*a* and fin 53*b*. Defrost heater 55 is, for example, a sheath heater or a cord heater. Defrost heater 55 is attached at a position away from pipe 53*a* of evaporator 53 while it is held in contact with fin 53*b*. An operation started with activation of defrost heater 55 is especially referred to as a "defrost operation". The defrost operation is performed during a period in which compressor 41 is stopped (details will be described later).

Defrost heater 55 generates an amount of heat that is enough to raise the chamber temperature up to a set temperature for cold storage chamber R1 when the outside air temperature is lower than the set temperature. As a result, even when the outside air temperature is lower than the chamber temperature, the chamber temperature can be raised with the operation of the defrost heater (change in the chamber temperature will be described later). The set temperature is a target temperature for cold storage chamber R1 and is set by a user when the user utilizes cold storage 1.

Defrost sensor 56 is disposed at a position away from pipe 53*a* while it is held in contact with fin 53*b*. Defrost sensor 56 detects a temperature of fin 53*b*.

Drain pan 57 receives water generated due to the defrost operation. Drain pan 57 is disposed under evaporator 53. The frost adhering to pipe 53*a* and fin 53*b* is melted by the defrost operation, whereby water is generated. The generated water falls down onto drain pan 57 and is drained to machine chamber R2 through a pipe (not illustrated).

Drain pan heater 58 is a heater for heating drain pan 57. Drain pan heater 58 is, for example, a sheath heater or a cord heater. An amount of heat generated by drain pan heater 58 is smaller than that generated by defrost heater 55. Drain pan heater 58 is attached to be held in contact with a rear surface of drain pan 57.

There is a possibility that the water received by drain pan 57 may be frozen by being cooled by evaporator 53. Even when the water received by drain pan 57 is frozen and an ice is generated, the ice can be melted with the operation of drain pan heater 58.

Defrost heater 55 and drain pan heater 58 are disposed in cooling region R1*b* as described above. In other words, defrost heater 55 and drain pan heater 58 are disposed in cold storage chamber R1.

Figure 4:
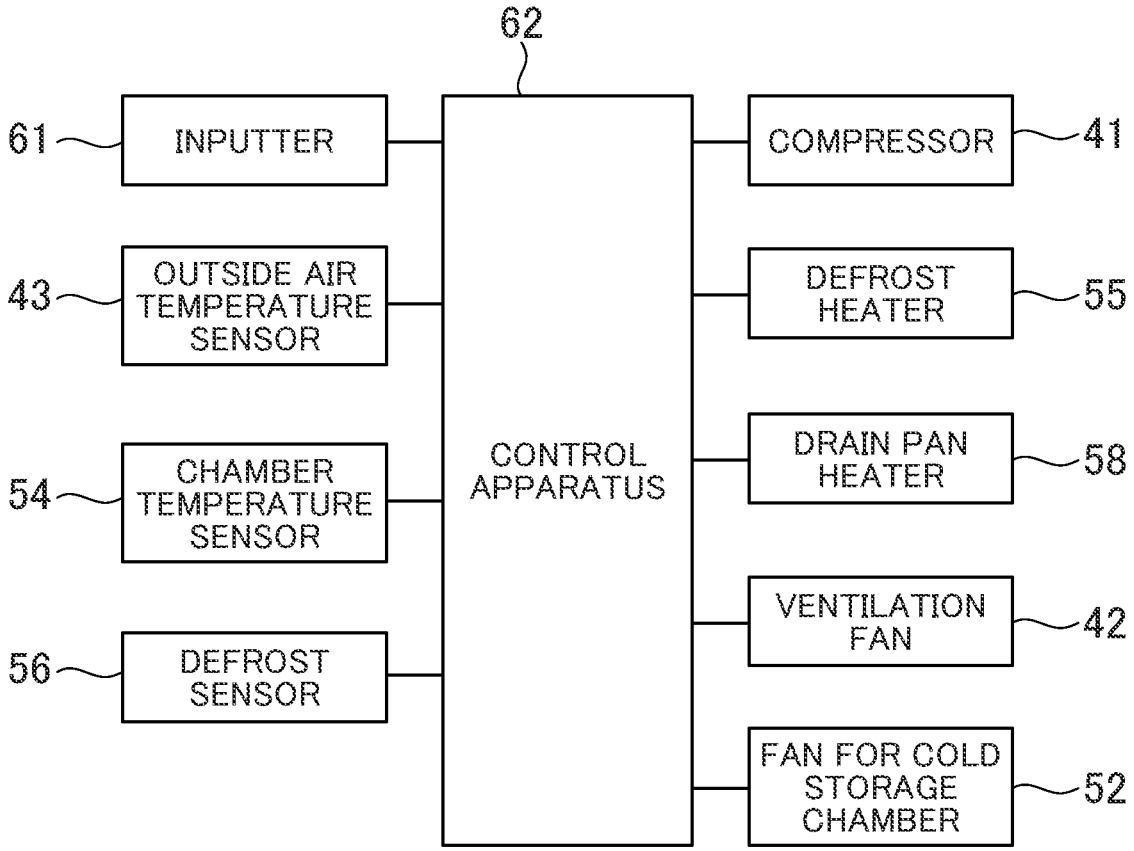
FIG. 4 is a block diagram of the cold storage.

As illustrated in FIG. 4, cold storage 1 further includes inputter 61 and control apparatus 62. Inputter 61 is used to input the set temperature for cold storage chamber R1. Inputter 61 is, for example, a touch panel.

Control apparatus 62 is a computer for supervising and controlling cold storage 1. Control apparatus 62 includes a storage apparatus for storing a computer program (hereinafter simply referred to as a "program") and a processor for executing the computer program.

Inputter 61, outside air temperature sensor 43, chamber temperature sensor 54, defrost sensor 56, compressor 41, defrost heater 55, drain pan heater 58, ventilation fan 42, and fan 52 for the cold storage chamber are electrically connected to control apparatus 62. Control apparatus 62 obtains the set temperature input through inputter 61, the temperature detected by outside air temperature sensor 43, the temperature detected by chamber temperature sensor 54, and the temperature detected by defrost sensor 56. Control apparatus 62 controls compressor 41, defrost heater 55, drain pan heater 58, ventilation fan 42, and fan 52 for the cold storage chamber based on the set temperature, the temperature detected by outside air temperature sensor 43, the temperature detected by chamber temperature sensor 54, and the temperature detected by defrost sensor 56.

Control for compressor 41, realized with control apparatus 62 executing the program, will be described below with reference to a flowchart of FIG. 5. While the program is being executed, ventilation fan 42 and fan 52 for the cold storage chamber are controlled to rotate continuously. Furthermore, at the start time of the execution of the program, compressor 41 is stopped.

Control apparatus 62 determines in S10 whether or not the outside air temperature is lower than the chamber temperature. The outside air temperature is the temperature detected by outside air temperature sensor 43. The chamber temperature is the temperature detected by chamber temperature sensor 54.

If the outside air temperature is equal to or higher than the chamber temperature (S10: NO), control apparatus 62 determines in S11 whether or not the chamber temperature is equal to or higher than a first threshold. The first threshold is a threshold set to operate compressor 41 when the outside air temperature is equal to or higher than the chamber temperature. The first threshold is determined based on the set temperature. The first threshold is a temperature obtained by adding a first specified value (for example, 0.5) to the set temperature.

If the chamber temperature is lower than the first threshold (S11: NO), control apparatus 62 returns the program to S10. On the other hand, if the chamber temperature is equal to or higher than the first threshold (S11: YES), control apparatus 62 operates compressor 41 in S12.

Then, control apparatus 62 determines in S13 whether or not the chamber temperature is equal to or lower than a second threshold. The second threshold is a threshold set to stop compressor 41. The second threshold is determined, based on the set temperature, to a temperature lower than the first threshold. The second threshold is a temperature obtained by subtracting a second specified value (for example, 0.5) from the set temperature. The second specified value may be the same as or different from the first specified value.

If the chamber temperature is higher than the second threshold (S13: NO), control apparatus 62 repeatedly executes S13. On the other hand, if the chamber temperature is equal to or lower than the second threshold (S13: YES), control apparatus 62 stops compressor 41 in S14.

Furthermore, if it is determined in S10 that the outside air temperature is lower than the chamber temperature (S10: YES), control apparatus 62 determines in S15 whether or not the chamber temperature is equal to or higher than a third threshold. The third threshold is a threshold set to operate compressor 41 when the outside air temperature is lower than the chamber temperature.

The third threshold is determined, based on the set temperature, to a temperature higher than the first threshold. The third threshold is the temperature obtained by adding a third specified value (for example, 3) to the set temperature. The third specified value is a larger value than the first specified value. In other words, when the outside air temperature is lower than the chamber temperature, control apparatus 62 does not operate compressor 41 even if the chamber temperature rises up to the first threshold.

Furthermore, the third threshold is the temperature that is sufficiently lower than a temperature at which there is a possibility that the pharmaceuticals and so on stored in cold storage chamber R1 may be adversely affected. The first to third specified values are previously set in the program executed by control apparatus 62 in the manufacturing stage of cold storage 1.

If the chamber temperature is lower than the third threshold (S15: NO), control apparatus 62 returns the program to S10 without operating compressor 41. On the other hand, if the chamber temperature is equal to or higher than the third threshold (S15: YES), control apparatus 62 operates compressor 41 in S12. Then, control apparatus 62 executes S12 to S14 as described above. In such a manner, control apparatus 62 operates and stops compressor 41 by executing the program.

Figure 5:
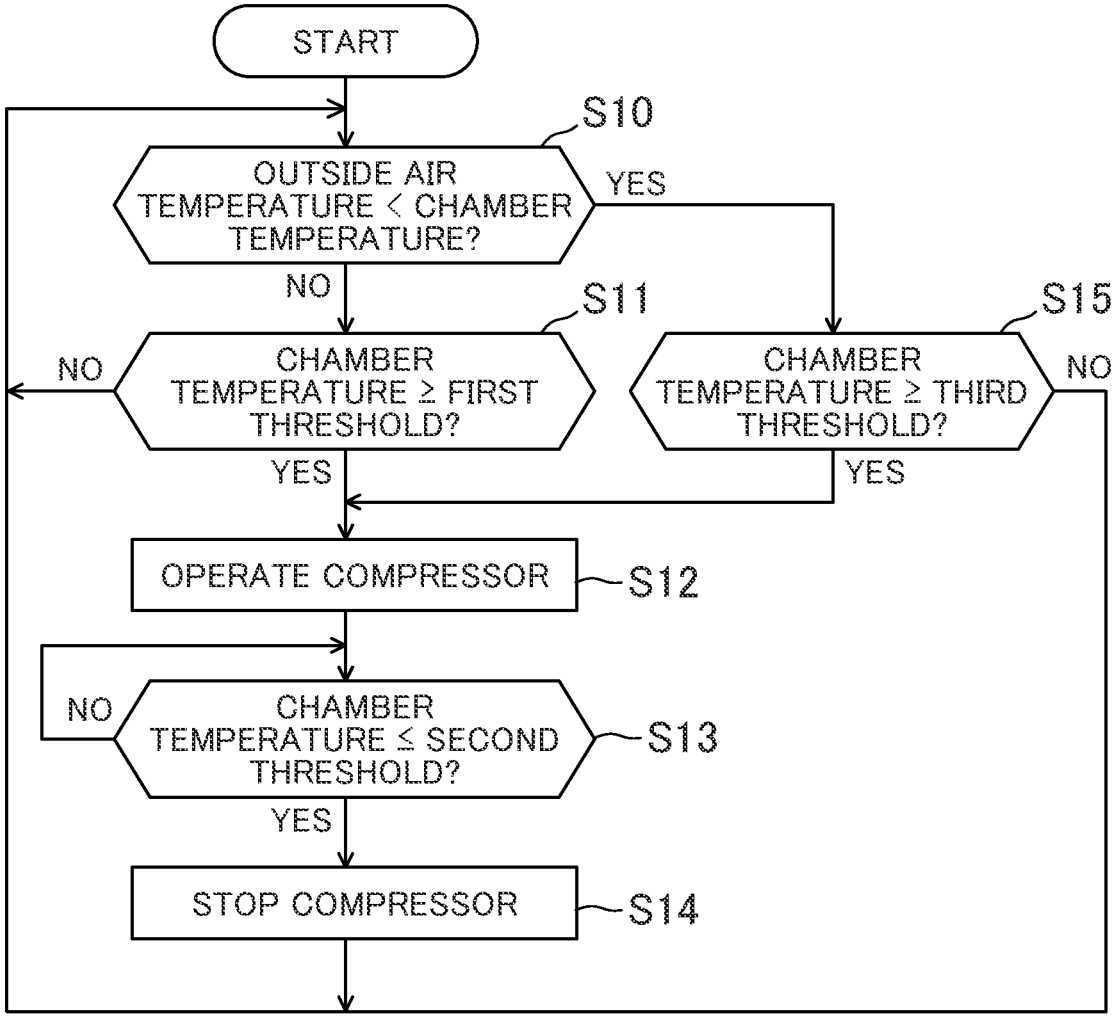
FIG. 5 is a flowchart of a program executed by a control apparatus.

At the same time as executing the program illustrated in FIG. 5, control apparatus 62 executes the above-described defrost operation as well. The defrost operation is performed, as described above, during the period in which compressor 41 is stopped. In other words, while the program is being executed, control apparatus 62 operates defrost heater 55 during the period in which compressor 41 is stopped.

More specifically, if the outside air temperature is equal to or higher than the chamber temperature during the execution of the program of FIG. 5, control apparatus 62 operates defrost heater 55 upon compressor 41 being stopped and stops defrost heater 55 upon the temperature detected by defrost sensor 56 rising up to a fourth threshold. The fourth threshold is a threshold set to stop defrost sensor 56.

Furthermore, if the outside air temperature is lower than the chamber temperature during the execution of the program of FIG. 5, control apparatus 62 operates defrost heater upon the chamber temperature dropping down to the second threshold, and stops defrost heater 55 upon the temperature detected by defrost sensor 56 rising up to the fourth threshold. At the start time of the defrost operation, defrost heater 55 is stopped.

The operations of compressor 41 and defrost heater 55, realized with control apparatus 62 executing the above-described program and the defrost operation, and changes in the chamber temperature and the temperature of evaporator 53 will be described below. In a specific example, the temperature of evaporator 53 is a temperature of fin 53*b*, namely the temperature detected by defrost sensor 56. Hereinafter, the temperature of evaporator 53 is referred to as the "fin temperature".

Figure 6:
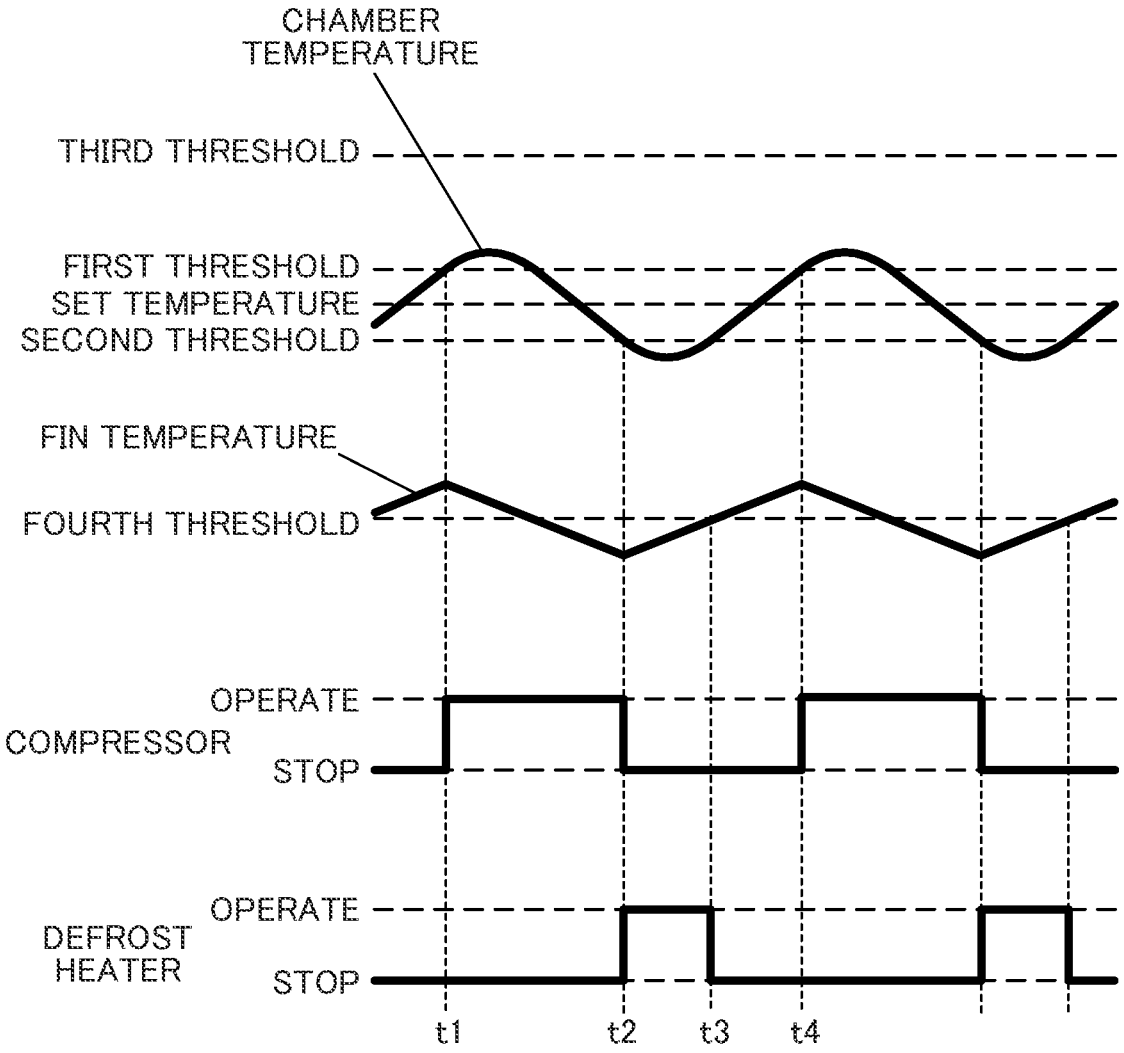
FIG. 6 is a time chart illustrating operations of a compressor and a defrost heater.

First, the case in which the outside air temperature is equal to or higher than the chamber temperature (S10: NO) is described with reference to a time chart illustrated in FIG. 6.

When compressor 41 and defrost heater 55 are stopped at the start time of the program and the defrost operation, the chamber temperature rises because the outside air temperature is equal to or higher than the chamber temperature. Upon the chamber temperature rising up to the first threshold (S11: YES, time t1), compressor 41 is operated (S12). Upon the chamber temperature dropping down to the second threshold (S13: YES, time t2) with the operation of compressor 41, compressor 41 is stopped (S14). Moreover, when compressor 41 is stopped (time t2), defrost heater 55 is operated for defrosting.

Because of the outside air temperature being equal to or higher than the chamber temperature and defrost heater 55 being operated, the chamber temperature and the fin temperature rise. Upon the fin temperature rising up to the fourth threshold (time t3), defrost heater 55 is stopped. Upon the chamber temperature further rising up to the first threshold (S11: YES, time t4), compressor 41 is operated again (S12). In such a manner, the operation and the stop of compressor 41 and the operation and the stop of defrost heater are repeated based on the individual thresholds, the chamber temperature, and the fin temperature such that compressor 41 and defrost heater 55 are operated alternately. As a result, the chamber temperature is adjusted to be held substantially at the set temperature.

Figure 7:
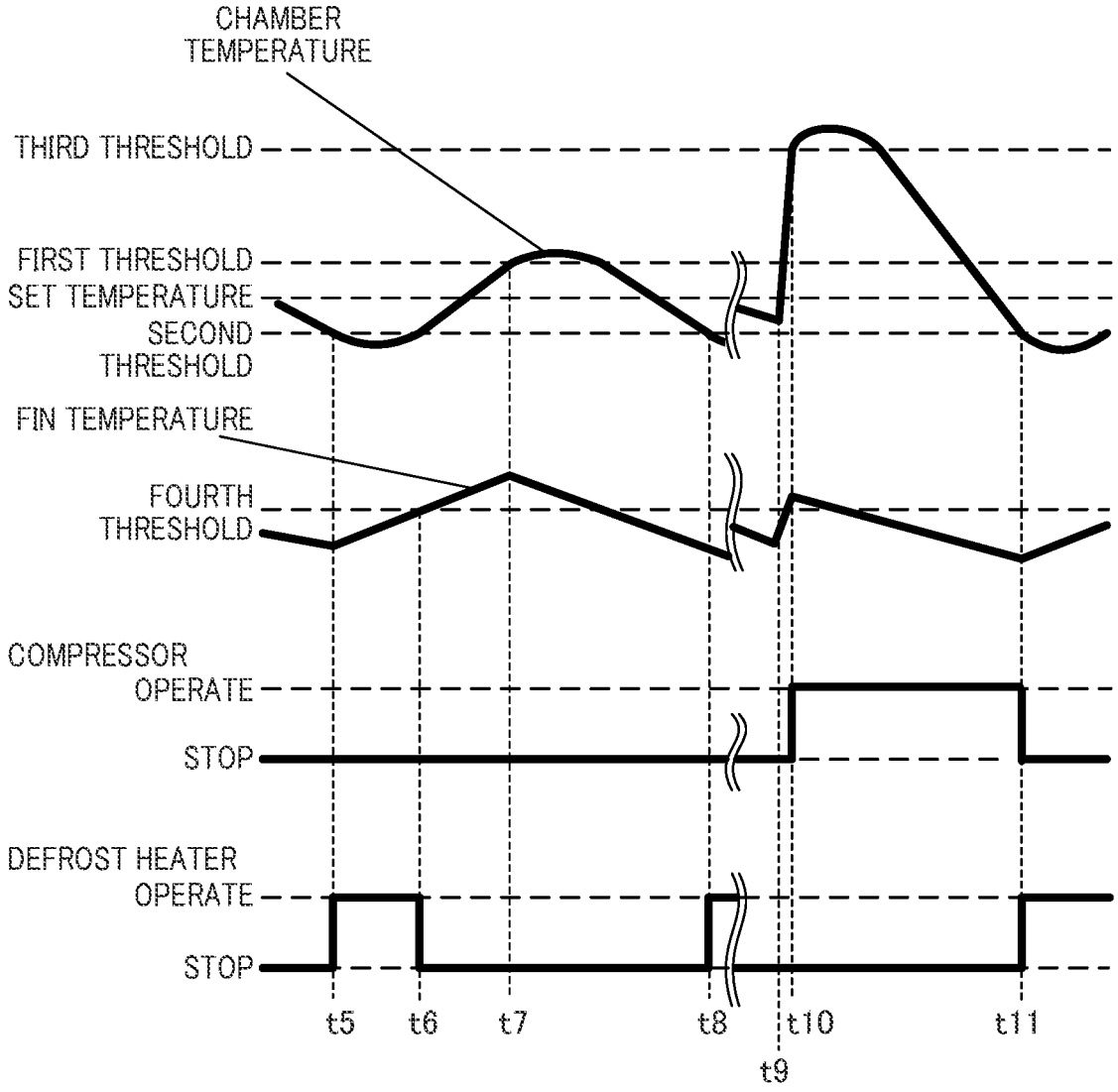
FIG. 7 is a time chart illustrating operations of the compressor and the defrost heater.

Next, the case in which the outside air temperature is lower than the chamber temperature (S10: YES) is described with reference to a time chart illustrated in FIG. 7.

Compressor 41 and defrost heater 55 are stopped at the start time of the program, but the chamber temperature drops because the outside air temperature is lower than the chamber temperature. Upon the chamber temperature dropping down to the second threshold (time t5), defrost heater 55 is operated.

The chamber temperature and the fin temperature rise due to the operation of defrost heater 55. Upon the fin temperature rising up to the fourth threshold (time t6), defrost heater 55 is stopped. The chamber temperature and the fin temperature further rise with residual heat of defrost heater 55. Even when the chamber temperature rises up to the first threshold, compressor 41 is not operated because the first threshold is lower than the third threshold (S15: NO, time t7).

Even with compressor 41 being not operated, the chamber temperature and the fin temperature start to drop because the outside air temperature is lower than the chamber temperature. The chamber temperature starts to drop before rising up to the third threshold. Stated another way, upon the fin temperature rising up to the fourth threshold, defrost heater is stopped such that the chamber temperature becomes lower than the third threshold.

Then, upon the chamber temperature dropping down to the second threshold (time t8), defrost heater 55 is operated again. As described above, when the outside air temperature is lower than the chamber temperature, the rise and the drop of the chamber temperature are repeated only by the operation and the stop of defrost heater 55 without operating compressor 41.

Accordingly, an operating time of compressor 41 can be reduced, and hence energy saving of cold storage 1 can be realized. Moreover, since the number of times that compressor 41 is to be operated can be reduced, durability of compressor 41 can be increased. In addition, the chamber temperature can be adjusted to be held substantially at the set temperature without operating compressor 41.

In the state in which the rise and the drop of the chamber temperature are repeated only by the operation and the stop of defrost heater 55 as described above, if the user newly puts pharmaceuticals and so on at a relatively high temperature into cold storage chamber R1, the chamber temperature starts to rise quickly (time t9). Upon the chamber temperature rising up to the third threshold (S15: YES, time t10), compressor 41 is operated (S12). Then, upon the chamber temperature dropping down to the second threshold (S13: YES, time t11), compressor 41 is stopped (S14), and defrost heater 55 is operated.

Accordingly, when the chamber temperature rises and reaches the third threshold higher than the first threshold, compressor 41 is operated to be able to drop the chamber temperature. As a result, the chamber temperature can be adjusted to the set temperature in a shorter period.

The present disclosure is not limited to the above-described embodiment. Modifications obtained by variously modifying the embodiment also fall within the scope of the present disclosure insofar as the modifications do not depart from the gist of the present disclosure.

For example, even when the chamber temperature rises up to the third threshold in the state in which the outside air temperature is lower than the chamber temperature, compressor 41 may be controlled not to operate. In that case, S15 illustrated in FIG. 5 is not executed, and control apparatus 62 repeatedly executes S10 if the outside air temperature is lower than the chamber temperature (S10: YES).

Instead of operating defrost heater 55 when compressor 41 is stopped in the state in which the outside air temperature is equal to or higher than the chamber temperature, defrost heater 55 may be operated upon the chamber temperature dropping down to the second threshold.

Defrost heater 55 may generate an amount of heat that is not enough to raise the chamber temperature up to the set temperature when the outside air temperature is lower than the set temperature for cold storage chamber R1. In that case, the amount of heat can be obtained to be able to raise the chamber temperature up to the set temperature by combining the amount of heat generated by defrost heater 55 and the amount of heat generated by drain pan heater 58 with each other when the outside air temperature is lower than the set temperature for cold storage chamber R1. Thus, drain pan heater 58 may be operated in addition to the operation of defrost heater 55.

Moreover, drain pan heater 58 may generate an amount of heat that is enough to raise the chamber temperature up to the set temperature when the outside air temperature is lower than the set temperature for cold storage chamber R1. In that case, drain pan heater 58 may be operated instead of defrost heater 55 when compressor 41 is not operated.

Moreover, when the outside air temperature is lower than the chamber temperature, defrost heater 55 may be stopped such that the chamber temperature becomes equal to or higher than the third threshold.

The disclosure of Japanese Patent Application No. 2021-044986 filed on Mar. 18, 2021 including the specification, claims, drawings and abstract is incorporated herein by reference in its entirety.

INDUSTRIAL APPLICABILITY

The present disclosure can be widely applied to cold storages, such as a cold storage for pharmaceuticals, a cold storage for blood, and a constant temperature container.

REFERENCE SIGNS LIST

1 cold storage
10 box
41 compressor
42 ventilation fan
43 outside air temperature sensor
53 evaporator
54 chamber temperature sensor
55 defrost heater
62 control apparatus
R1 cold storage chamber

The invention claimed is:

1. A cold storage comprising:

a box having a cold storage chamber;

a compressor constituting a refrigeration circuit that cools an inside of the cold storage chamber;

a defrost heater that heats an evaporator constituting the refrigeration circuit; and a control apparatus that controls the compressor and the defrost heater, wherein the control apparatus operates the defrost heater when the compressor is not operated, when an outside air temperature is equal to or higher than a chamber temperature in the cold storage chamber, the control apparatus operates the compressor upon the chamber temperature rising up to a first threshold and stops the compressor upon the chamber temperature dropping down to a second threshold lower than the first threshold, and when the outside air temperature is lower than the chamber temperature, the control apparatus does not operate the compressor until the chamber temperature rises up to a third threshold higher than the first threshold, and the control apparatus operates the compressor when the chamber temperature reaches the third threshold.

2. The cold storage according to claim 1, wherein, when the outside air temperature is lower than the chamber temperature, the control apparatus operates the defrost heater upon the chamber temperature dropping down to the second threshold.

3. The cold storage according to claim 2, wherein, when the outside air temperature is lower than a set temperature for the cold storage chamber, the defrost heater generates an amount of heat enough to raise the chamber temperature up to the set temperature.

4. The cold storage according to claim 2, wherein the control apparatus stops the defrost heater such that the chamber temperature becomes lower than the third threshold.

* * * * *